US010158184B2

(12) United States Patent
Boisnier et al.

(10) Patent No.: US 10,158,184 B2
(45) Date of Patent: Dec. 18, 2018

(54) ELECTRICAL CONNECTION DEVICE HAVING A TERMINAL BLOCK AND A BUSBAR ASSEMBLY FOR CONNECTING MULTIPLE CABLES

(71) Applicant: SAFRAN ELECTRICAL & POWER, Blagnac (FR)

(72) Inventors: Benjamin Boisnier, Colomiers (FR); Philippe Pierre Avignon, Toulouse (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 0 days.

(21) Appl. No.: 15/742,753

(22) PCT Filed: Jul. 8, 2016

(86) PCT No.: PCT/FR2016/051745
§ 371 (c)(1),
(2) Date: Jan. 8, 2018

(87) PCT Pub. No.: WO2017/009557
PCT Pub. Date: Jan. 19, 2017

(65) Prior Publication Data

US 2018/0212345 A1 Jul. 26, 2018

(30) Foreign Application Priority Data

Jul. 16, 2015 (FR) ..... 15 56706

(51) Int. Cl.
*H01R 9/22* (2006.01)
*H01R 4/34* (2006.01)
(Continued)

(52) U.S. Cl.
CPC ..... *H01R 9/223* (2013.01); *H01R 4/34* (2013.01); *H01R 9/24* (2013.01); *H01R 11/12* (2013.01); *H01R 13/447* (2013.01)

(58) Field of Classification Search
CPC . H01R 4/34; H01R 9/223; H01R 9/24; H01R 9/2416; H01R 11/12; H01R 13/426; H01R 13/447; H01R 13/514
(Continued)

(56) References Cited

U.S. PATENT DOCUMENTS 5,368,506 A * 11/1994 Heimbrock ..... H01R 4/36 439/709
6,255,927 B1 * 7/2001 Fischer ..... H01R 11/12 335/202
(Continued)

FOREIGN PATENT DOCUMENTS

DE 199 13 430 A1 9/2000
EP 1 296 340 A1 3/2003
(Continued)

OTHER PUBLICATIONS

English translation of PCT/FR 2016 151745 dated Oct. 10, 2016.*
(Continued)

*Primary Examiner* — Chandrika Prasad
(74) *Attorney, Agent, or Firm* — Pearne & Gordon LLP

(57) ABSTRACT

The invention relates to an electrical connection device (100) including a terminal block (10) and busbar (12) assembly, the terminal block (10) including a first connection point (6) for receiving the lug (24) of a first cable and a second connection point (7) for receiving the lug (20) of a second cable. The second connection point (7) is adjacent to and offset from the first connection point (6). The connection points (6, 7) are positioned such that, when the two cables are connected substantially parallel to the axis, the
(Continued)

second cable or the lug (20) thereof prevents access to the first connection point (6). The connection points (6, 7) are preferably offset horizontally and vertically. Preferably, a control cable is connected to the first connection point (6) and a power cable is connected to the second connection point (7).

6 Claims, 2 Drawing Sheets

(51) Int. Cl.
*H01R 11/12* (2006.01)
*H01R 13/447* (2006.01)
*H01R 9/24* (2006.01)

(58) Field of Classification Search
USPC ..... 439/708–711
See application file for complete search history.

(56) References Cited

U.S. PATENT DOCUMENTS

| | | | | |
|---|---|---|---|---|
| 6,835,104 | B2 * | 12/2004 | West | H01R 31/00 439/709 |
| 7,786,386 | B2 | 8/2010 | Tarchinski | |
| 7,862,389 | B2 * | 1/2011 | Pizzi | H01R 4/28 439/709 |
| 9,153,893 | B2 * | 10/2015 | Yamada | H01R 13/42 |
| 2003/0068923 | A1 | 4/2003 | Feller et al. | |
| 2014/0134891 | A1 * | 5/2014 | Yamada | H01R 13/42 439/709 |
| 2015/0263442 | A1 * | 9/2015 | Bakatsias | H01R 12/75 439/78 |
| 2017/0025805 | A1 * | 1/2017 | Pizzi | H01R 9/2675 |

FOREIGN PATENT DOCUMENTS

| | | | |
|---|---|---|---|
| EP | 2 731 208 | A1 | 5/2014 |
| FR | 2 715 775 | A1 | 8/1995 |
| FR | 2 786 612 | A1 | 6/2000 |
| WO | 2008-152069 | A1 | 12/2008 |
| WO | 2017-009558 | A1 | 1/2017 |
| WO | 2017-009559 | A1 | 1/2017 |

OTHER PUBLICATIONS

International Search Report for International Application No. PCT/FR2016/051745 dated Oct. 10, 2016.
Written Opinion for International Application No. PCT/FR2016/051745 dated Oct. 10, 2016.
French Search Report issued in Patent Application No. FR 1556706 dated May 20, 2016.

* cited by examiner

ELECTRICAL CONNECTION DEVICE HAVING A TERMINAL BLOCK AND A BUSBAR ASSEMBLY FOR CONNECTING MULTIPLE CABLES

TECHNICAL FIELD

The invention relates to the field of electrical power connection, and more specifically to the field of terminal blocks combined with busbars in order to enable several elements to be connected to the terminal block of the electrical power connection.

More particularly, the invention relates to an electrical connection device comprising a terminal block and busbar assembly for connecting separately to the lugs of two electrical cables, and ideally, also to other pieces of electronic equipment.

PRIOR ART

The electrical connection assemblies combining terminal blocks and busbars can be found in many industries, and particularly in those associated with the field of electricity and power connection. Such assemblies are used to connect a busbar to an electrical structure, for example an electrical cable, and potentially to other electronic equipment at the same time.

An example of an electrical power connection between a busbar and two cables is described in patent U.S. Pat. No. 7,786,386 B2. This document describes a first busbar which is connected to a power cable, and also to a second cable which is connected to another busbar. The two cables are attached, as generally practiced in the industry, at the same point of the busbar with the same screw passing through the lugs of the first and second cables and of the busbar. Consequently, in order to remove a cable, for example the power cable, this requires that the screw be undone, and therefore that both of the cables be disconnected from the connection.

Sometimes, it is preferable that the second cable not be disconnected from the connection. For example, the second cable can be a control cable connected to a connection between a busbar and a power cable in order to monitor the connection between the two and being linked to a piece of control equipment such as a contactor. In the case where such a control cable is disconnected to due to the removal of a first cable, this can result in the fact that the contactor has to be reinitialised when the connection is made again.

With the purpose of preventing the disconnection of a cable from affecting the others, patent FR 2 786 612 B1 proposes a terminal block and busbar assembly, wherein the terminal block has two separate connection points in order to receive two cables. As such, it makes it possible to obtain that two cables can be disconnected individually. However, this terminal block has a rather substantial width and takes up a lot of space.

Another defect of these electrical connections is linked to the aspect of foreign object damage (FOD). The connections described in the documents hereinabove and/or in prior art have a non-negligible risk of causing FOD or being subjected to FOD. More particularly, a screw that can be unscrewed, for example, can be separated easily from the electrical connection and can cause an FOD. In addition, the electrical connections are comprised of many portions which increase this risk and make them more difficult to install. Furthermore, given that the connections are exposed, or are not insulated enough, there is the risk that, during maintenance, an installer tool, for example a screwdriver or an Allen key, can fall onto the electrical connection and cause a short circuit.

DISCLOSURE OF THE INVENTION

The object of this invention is consequently to overcome the aforementioned needs and disadvantages by proposing an electrical connection device comprising a terminal block and busbar assembly adapted for improved connection between the busbar and the cables, and which does not take up a lot of space. Another object is to provide an electrical connection device comprising fewer parts, which is simple to install, and having anti-FOD characteristics, i.e. having a substantially reduced probability of causing FOD or of being subjected to FOD, such anti-FOD characteristics being, in particular in the aviation industry, highly sought.

This invention as such proposes an electrical connection device comprising a terminal block and busbar assembly adapted to connect to the lugs of two cables, the terminal block comprising a first connection point for receiving the lug of a first cable and a second connection point for receiving the lug of a second cable, characterised in that the second connection point of the terminal block is adjacent to and offset from the first connection point substantially in the direction of a first axis of the terminal block, the connection points being positioned in such a way that, when the cables are both connected substantially parallel to the axis of the terminal block, the second cable or the lug thereof prevents access to the first connection point.

Preferably, the second connection point of the terminal block is furthermore offset substantially in the direction of a second axis perpendicular to said first axis of the terminal block.

Advantageously, the second connection point is offset horizontally and vertically from the first connection point, being farther away and higher from an end of the terminal block than the first connection point, the first connection point being adapted to receive a lug of a control cable, and the second connection point being adapted for receiving a lug of a power cable.

Even more preferably, the terminal block comprises a third connection point for receiving a contactor, the third connection point being substantially offset in the direction of the first axis of the terminal block, and substantially in the direction of the second axis of the terminal block, being farther away and higher from an end of the terminal block than the second connection point.

Preferably, the electrical connection device further comprises a busbar connected to the terminal block, a lug of a control cable connected to the first connection point and a lug of a power cable connected to the second connection point, the cables being both connected substantially parallel to the first axis of the terminal block, the power cable or the lug thereof preventing access to the first connection point.

Moreover, the invention has for object an electrical connection device and insulator assembly, characterised in that it comprises an electrical connection device such as described hereinabove and an insulator, the terminal block being arranged in a first portion of the insulator provided with a bottom and with walls, the walls extending substantially parallel to the first axis of the terminal block and in the vicinity of each side of the terminal block and extending to a height greater than that of the terminal block.

Preferably, the busbar is arranged in a second portion of the insulator provided with a bottom and with walls, the walls extending substantially parallel to the busbar and in the vicinity of each side of the busbar and extending to a height that is higher than that of the busbar, wherein the first portion of the insulator is arranged on the second portion, and a cover is secured on the first portion of the insulator in order to encase the device.

BRIEF DESCRIPTION OF THE DRAWINGS

It is described in what follows, by way of non-limiting example, diagrammatically and partially, an embodiment of the invention, by referring to the annexed drawing, wherein.

In all of these figures, identical references can designate identical or similar elements. Furthermore, the figures are not necessarily carried out according to a uniform scale, in order to make the figures easier to read.

DETAILED DESCRIPTION OF A PARTICULAR EMBODIMENT

Figure 1:
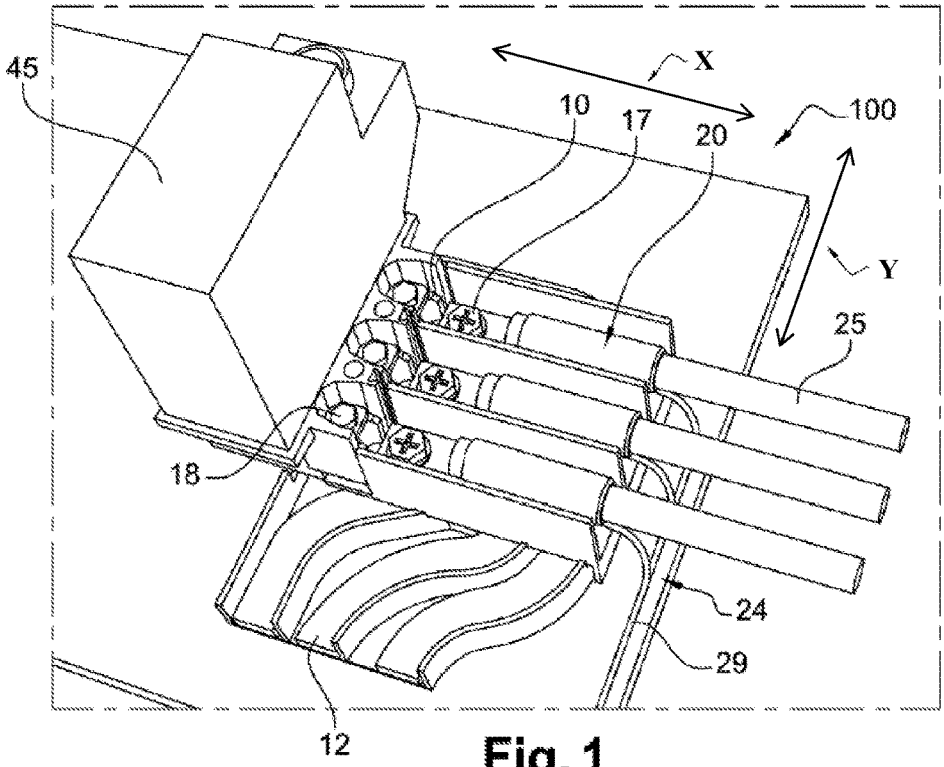
FIG. 1 shows a perspective view of several electrical connection devices according to the first embodiment.

FIG. 1 shows a first embodiment of several electrical connection devices 100, with each one comprising an assembly of a terminal block 10 and of a busbar 12 which is connected to a lug 20 of an electrical power cable 25 and a lug 24 of an electrical control cable 29 in order to monitor the connection, and also to a contactor 45. The electrical connection devices 100 are arranged in an insulator 30.

According to this arrangement, the terminal block 10 extends along a first axis substantially parallel to the direction X according to which the power cables 25 extend, between a first end and a second end.

The control cable 29 is connected to a first connection point 6 near the first end of the terminal block (towards the right of the figure), and the power cable 25 is connected to a second connection point 7 approximately in the middle of the two ends of the terminal block. The lug 24 of the control cable 29 is not clearly visible in this FIG. 1 because it is located underneath the power cable 25. The contactor 45 is connected to the terminal block 10 at a third connection point 8 near the second end (towards the left of the figure). Finally, the terminal block 10 is placed in contact with a busbar 12.

Figure 2:
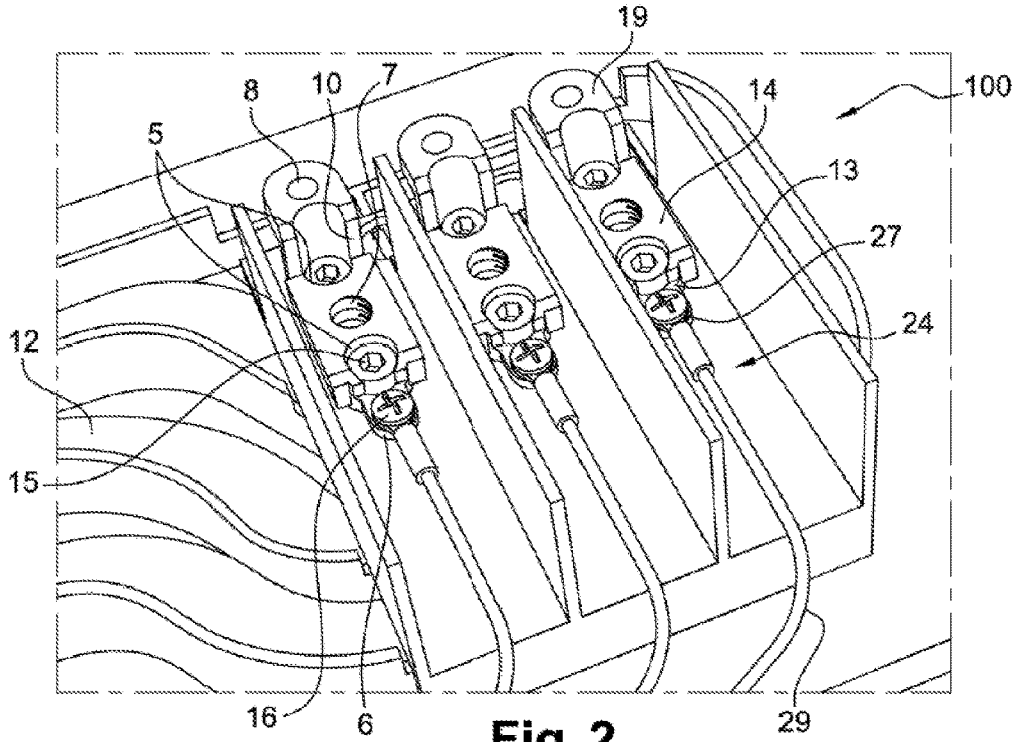
FIG. 2 shows a perspective view of several electrical connection devices according to the first embodiment of FIG. 1, in such a way as to view the terminal block clearly.

FIG. 2 shows the same electrical connection devices 100 as those of FIG. 1. However, the power cables 25 and the contactor 45 are not shown for reasons of clarity.

The two connection points 6, 7 for the lugs of the cables are substantially offset in the direction X of the first axis of the terminal block 10 and substantially in the direction Y of a second axis perpendicular to the first axis. A third connection point 8 is also provided for the connection of a contactor 45 or of a piece of electronic equipment, which is again substantially offset in the direction X of the first axis of the terminal block 10 and substantially in the direction Y of the second axis perpendicular to the first axis.

The offsetting of the connection points in the direction X of the first axis of the terminal block, which is a horizontal offset in this case, enables, to a certain degree, the cables to be connected parallel and in the vicinity of one another. The offsetting of the connection points in the direction perpendicular to the first axis, which is a vertical offset in this case, is furthermore used to accommodate the thickness of the cables and the lug thereof, and enables the cables to be connected to one another.

Consequently, the second connection point 7 on the terminal block 10 is effectively farther and higher from the first end of the terminal block 10 than the first connection point 6. The connection points 6, 7, 8 include a hole suitable for receiving a fastening element 16, 17, 18, for example a screw, but they can take other forms. The holes 6, 7, 8 are substantially located on the same side of the terminal block 10, or more precisely, on the plateaus 13, 14, 19 at different levels of the same side and which are oriented upwards, in a direction that is substantially perpendicular to the first axis of the terminal block 10. This enables a lug 24 of a first cable 29 to be positioned at the first connection point 6 of the terminal block 10, and a lug 20 of a second cable 25 to be placed at the terminal block 10 slightly above the first cable 29 or the lug thereof 24, while remaining parallel with the first cable 29 or the lug thereof 24.

The lugs 20, 24 here, in turn, are of the type with a flat end 22, 27 slightly offset relative to the axis of the cable 25, 29 and supplied with a hole 23, 28. Given that the power cable and the lug thereof conduct more current, they are typically wider than the control cable and the lug thereof. In order to connect the cables 25, 29 to the terminal block, the electric control cable 29 is first of all secured to the terminal block, then the power cable 25 is secured. Each time, the flat end 22, 27 of the lug of the cable is placed on the plateau 13, 14 of the terminal block until the holes are aligned and it is secured thereto with a screw 16, 17. Of course, other types of elements for fastening can be considered, and also other types of lugs.

Once the two cables 25, 29 are secured, the power cable 25 or the lug thereof 20 prevents the control cable 29 from being disconnected. In particular, the power cable 25 or the lug thereof 20 covers the screw 16 securing the control cable 29 from above, and therefore limits or prevents access to the screw 16 from above. If the control cable 29 has to be disconnected, it is necessary for the power cable 25 to be in a position where it does not cover the screw 16, typically disconnected from the connection point thereof 7. However, the power cable 25 can be disconnected without requiring that the control cable 29 also be disconnected. Moreover, this vertical installation of the cables 25, 29 takes up less surface area.

Figure 3:
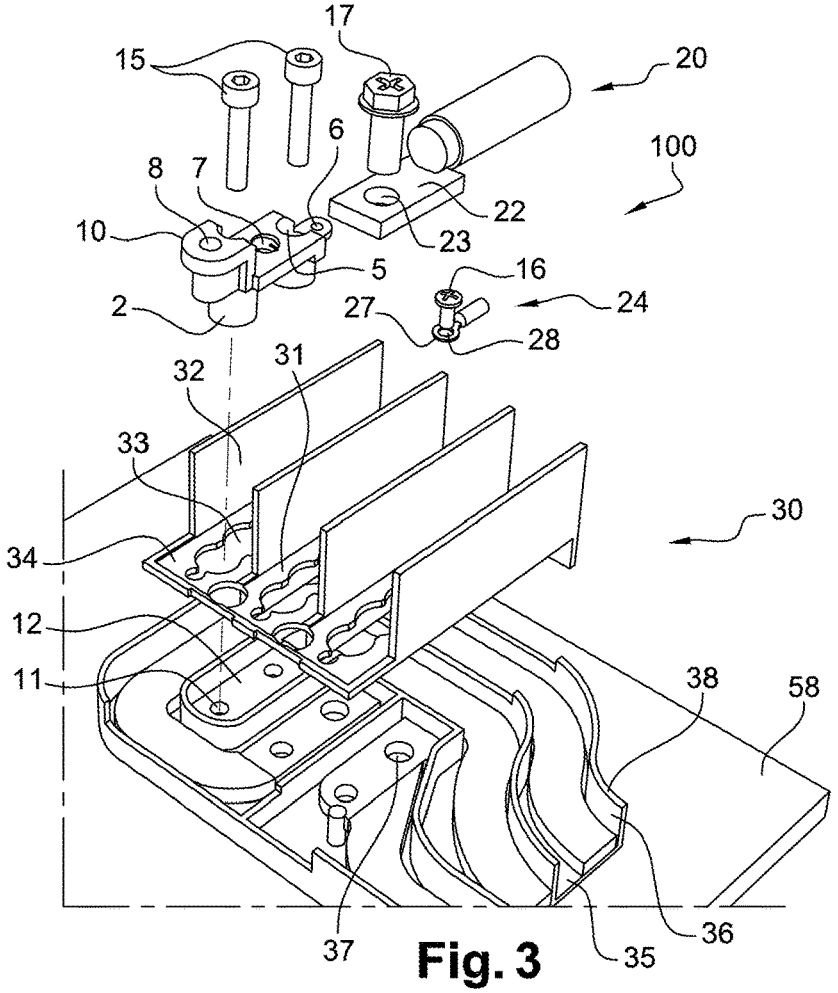
FIG. 3 shows an exploded view in perspective of an electrical connection device of FIG. 1, in such a way as to view the assembly.
Figure 4:
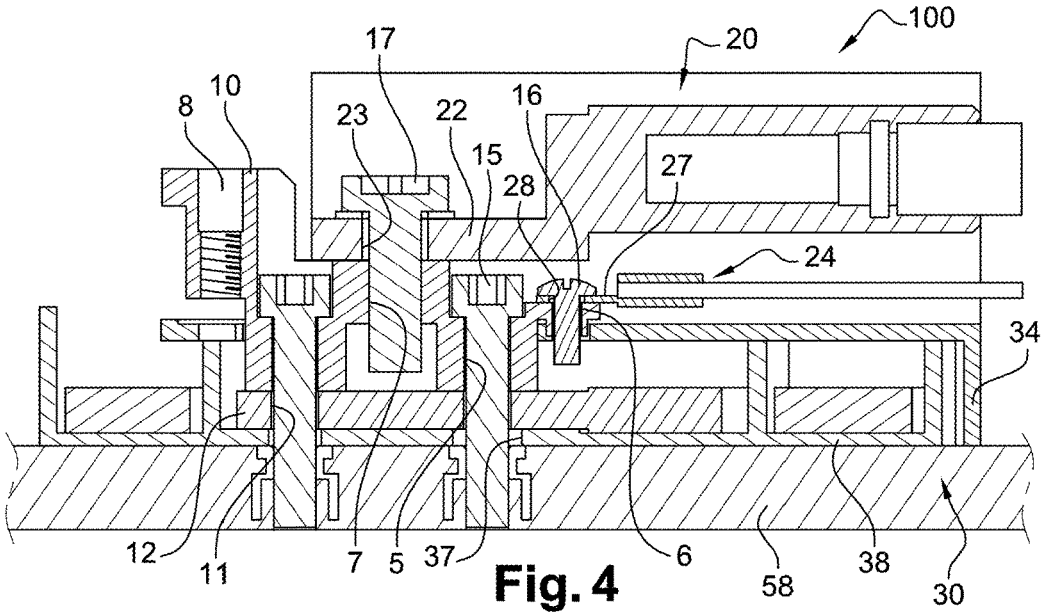
FIG. 4 shows a cross-section view of an electrical connection device of FIG. 1.

FIG. 3 shows an exploded view of the electrical connection device 100 and of the insulator 30 wherein it is placed, and FIG. 4 shows a cross-section view of the electrical connection device 100. These figures aim to show the assembly of the terminal block 10 relatively to the busbar 12 and the lugs 20, 24, and also of the anti-FOD characteristics, i.e. characteristics for preventing, as much as possible, the device from becoming damaged by a foreign body or causing foreign object damage.

The terminal block 10 further comprises two vertical cylindrical feet 2, with each one having a through-hole 5 in a centred manner. These feet 2 are installed in electrical contact on the busbar 12. Two screws 15 are inserted into the holes of the feet in order to secure the terminal block 10 against the busbar 12. The electrical connection device 100 is ideally installed in an insulator 30 which is, generally, an insulating casing provided on the connection in order to protect it and in order to prevent the latter, or the conducting parts thereof, from being exposed.

The insulator 30 is provided in two main portions 34, 38. A first portion 34 is intended mainly for the terminal block and the lugs of the cables, while a second portion 38 is intended mainly for the busbar. The first portion 34 is placed on the second portion 38.

The first portion 34 is provided with a bottom 31 and with walls 32 at each side of the terminal block 10, and very close to the sides of the latter. These walls rise substantially vertically to a height greater than that of the terminal blocks 10. Furthermore, the walls 32 extend substantially along the connection, i.e. substantially parallel and along the terminal block 10 and the lug 20, 24. The bottom 31 comprises the openings 33 adapted for receiving the cylindrical feet 2 of the terminal block through them.

The second portion 38 of the insulator 30 has, in turn, a bottom 35 and walls 36 on each side of the busbar. These walls 36 rise substantially vertically to a height greater than that of the busbars 12. The walls 36 extend substantially along the length of the busbar 12, i.e. substantially parallel and along the busbar 12, at least in the vicinity of the connection. The bottom 35 comprises the holes 37 adapted for receiving the two screws 15 in order to secure the terminal block 10.

In order to install a connection device 100 in the insulator, the second portion 38 is at first mounted on a structure, for example a composite honeycomb panel 58, with its holes 37 aligning with those provided on the panel 58. The busbar 12, also provided with holes 11, is then placed in the insulator 30 or in the compartment thereof in the latter. The first portion 34 of the insulator 30 is then mounted on the second portion 38, and there can be therein formations that cooperate such as a recess or clips enabling an engagement between them. This vertical assembly makes it possible to save surface area on the panel 58.

The terminal block 10 is then introduced from the top with the feet thereof 2 passing through the opening 33 on the bottom 31 of the first portion 34 until they touch the busbar 12. Two screws 15 are then inserted into the holes 5 on the terminal block. These screws 15 pass through the terminal block, the first portion 34 of the insulator, the busbar 12, the second portion of the insulator 38 and are secured on the composite panel 58 in order connect all of the portions together at the same time.

Then, the lug 24 of the control cable 29 is connected with a screw 16 to the first connection point 6 on the terminal block 10, and the lug 20 of the power cable 25 is connected with a screw 17 to the second connection point 7. As is the result in FIG. 4, the terminal block 10 is designed for receiving the power lug 20 at a position where it will prevent the screws 16 for the lug 24 of the control cable 29 and the screws 15 for the terminal block 10 from being accessible, and at the same time, prevent these screws 15, 16 from exiting the holes thereof 5, 6 in the event they come loose. In the case where a screw comes loose, it abuts against the lug 20 which would then prevent it from completely exiting and from separating from the device.

A contactor 45 can be placed and connected to the terminal block 10 by using a screw 18, possibly before the cables 25, 29 are connected. Such a contactor can also be connected to the other terminal blocks or contactors. Of course, other contactors can be connected to the control cable (instead of the contactor shown). Each terminal block 10 and each busbar 12 are as such in the insulator 30, or substantially in its own compartment in the insulator 30. The insulator 30 is made of an insulating composite material.

In the case of an object, for example a tool of an installer, falling onto the insulator wherein the electrical connection devices are housed, it is highly likely that it will land on the walls 32, 36 of the insulator 30 or on an electrical connection device 100 only. Consequently, the risk of an object touching two terminal blocks, two busbars or two lugs at the same time, and thereby causing a short circuit, is substantially reduced. For additional anti-FOD protection, the insulator 30 can be incorporated with a cover (not shown) in order to encase the electrical connection devices 100.

The invention therefore enables a connection between a terminal block and busbar assembly with two cables and their lugs which are in parallel and slightly above one another, and also enables a lug of a cable to be removed without requiring the other to also be removed. The invention furthermore has anti-FOD characteristics, in that it is designed with few parts, and to prevent the loss of screws and protect the terminal block and the connection.

The embodiment described hereinabove is by way of example and must not be interpreted in a limiting way. It is should be noted that other embodiments or improvements to the invention will be obvious for those skilled in the art without departing from the general scope of the invention. For example, the terminal block can be designed with another connection point in order to secure a lug of another cable above the other two and prevent access to the second connection point.

Note that the expressions "direction of the axis" does not necessarily mean that the direction is along the same axis, but can be along a parallel axis extending in the same direction.

The invention claimed is:

1. An electrical connection device and insulator assembly comprising an electrical connection device and an insulator, the electrical connection device comprising a terminal block and busbar assembly adapted to connect to lugs of two cables, the terminal block comprising a first connection point for receiving the lug of a first cable and a second connection point for receiving the lug of a second cable, the second connection point of the terminal block being adjacent to and offset from the first connection point substantially in a direction of a first axis of the terminal block, the connection points being positioned in such a way that, when the cables are both connected substantially parallel to the direction of the first axis of the terminal block, the second cable or the lug thereof prevents access to the first connection point, the terminal block being arranged in a first portion of the insulator provided with a bottom and with walls, the walls extending substantially parallel to the direction of the first axis of the terminal block and in the vicinity of each side of the terminal block, wherein the walls extend to a height greater than that of the terminal block.

2. The assembly according to claim 1, wherein the second connection point of the terminal block is furthermore offset substantially in a direction of a second axis perpendicular to the direction of said first axis of the terminal block.

3. The assembly according to claim 2, wherein the second connection point is offset horizontally and vertically from the first connection point, being father away and higher from an end of the terminal block than the first connection point, the first connection point being suitable for receiving a lug of a control cable, and the second connection point being suitable for receiving a lug of a power cable.

4. The assembly according to claim 3, wherein the terminal block comprises a third connection point in order to receive a contactor, the third connection point being offset substantially in the direction of the first axis of the terminal block, and substantially in the direction of the second axis of the terminal block, being farther away and higher from an end of the terminal block than the second connection point.

5. The assembly for an electrical connection according to claim 1, wherein it further comprises a busbar connected to the terminal block, a lug of a control cable connected to the first connection point and a lug of a power cable connected to the second connection point, the cables, being both connected substantially parallel to the direction of the first axis of the terminal block, the power cable or the lug thereof preventing access to the first connection point.

6. The assembly for an electrical connection according to claim 1, wherein the busbar is arranged in a second portion of the insulator provided with a bottom and with walls, the walls extending substantially parallel to the busbar and in the vicinity of each side of the busbar and extending to a height that is greater than that of the busbar, wherein the first portion of the insulator is arranged on the second portion.

* * * * *